United States Patent [19]

Wünnenberg et al.

[11] 3,930,534

[45] Jan. 6, 1976

[54] MOLD FOR CONTINUOUS CASTING OF SLAB INGOTS

[75] Inventors: Klaus Wünnenberg, Duisburg; Gerd Vogt, Meerbusch, both of Germany

[73] Assignee: Mannesmann Aktiengesellschaft, Dusseldorf, Germany

[22] Filed: Feb. 11, 1974

[21] Appl. No.: 441,203

[30] Foreign Application Priority Data

Feb. 14, 1973 Germany ..... 2307719

[52] U.S. Cl. ..... 164/283

[51] Int. Cl.[2] ..... B22D 11/06; B22D 11/124

[58] Field of Search..... 164/283, 281, 282, 283 R, 164/283 S, 283 M, 283 MS, 283 MT, 284–289

[56] References Cited

UNITED STATES PATENTS

| | | | |
|---|---|---|---|
| 425,846 | 4/1890 | Atha | 164/283 M X |
| 2,079,644 | 5/1937 | Williams | 164/282 X |
| 3,834,445 | 9/1974 | Raschke | 164/283 R X |

*Primary Examiner*—Francis S. Husar
*Assistant Examiner*—John S. Brown
*Attorney, Agent, or Firm*—Ralf H. Siegemund

[57] ABSTRACT

A mold for continuous casting of slab ingots is constructed to have wide sides which extend lower than the narrow sides leaving gaps below the bottom edges of the narrow mold sides in which rolls are placed for engaging the emerging narrow side of the ingot held in the same level still by the wide sides of the mold. The force exerted by these rolls upon the ingot is related to the thickness thereof.

3 Claims, 2 Drawing Figures

MOLD FOR CONTINUOUS CASTING OF SLAB INGOTS

BACKGROUND OF THE INVENTION

The present invention relates to a liquid cooled mold for continuous casting of slab ingots, having wide sides and narrow sides, wherein the wide sides of the mold project beyond the narrow sides in direction of casting.

Continuous casting of slab ingots requires that the ingot be well supported, particularly where the still liquidous core exerts ferrostatic pressure onto the growing skin. Support is more critical the higher a casting speed has been chosen. The usual arrangement for this purpose includes solid wall molds, particularly in the surface level of steel in the mold. Such a mold is about 500 to 1200 mm long (about 20 to about 50 inches). A frame with support rolls is usually provided under the mold to support the withdrawn ingot. It is also known to use adjustable rolls under the narrow sides of the mold for additionally supporting the ingot (see e.g. U.S. Pat. No. 2,284,503).

A solid wall for a mold provides primarily for positive shaping of the ingot-to-be, right in the casting and surface level of the mold. The ingot is supported until the skin is sufficiently thick and capable of load bearing while being self supporting at least to some extent. It should be noted, that too long a mold while seemingly advantageous from the standpoint of providing support, produces considerable friction for the extraction and withdrawal of the ingot from the mold, which friction increases down with distance from the surface level. Eventually friction may become so great that the skin may be damaged and ruptures. Moreover, one has to consider that some shrinkage of the ingot occurs in the lower portion of the mold which, on the one hand, may lead to separation of the ingot skin from the narrow sides of the mold while, on the other hand, the ingot may expand on the wide sides due to creepage of the skin on the narrow sides by operation of the ferrostatic pressure.

Ingot shrinkage is usually compensated by, in a general way, conicity of the mold, i.e. by having the narrow sides slightly inclined towards each other. That, however, may result in a disadvantage; the expansion as produced under ferrostatic pressure may wear the narrow mold sides to an increasing extent in the lower portion of the mold. Furthermore any forcing of the narrow sides of the ingot against the mold sides occurs more or less at random so that heat is transferred from the ingot into the mold sides in a rather nonuniform, even outright inaffectual manner.

DESCRIPTION OF THE INVENTION

It is an object of the present invention to construct a mold for continuous casting of slab ingots to obtain effective cooling on the narrow mold sides while any bulging of the ingot is prevented. It is another object of the invention to provide a mold for continuous casting of slab ingots wherein the narrow mold sides will wear less than usual in known molds while the skin should not be damaged.

It is a specific object of the present invention to improve molds for continuous casting of slab ingots having longer wide sides than narrow sides.

These and other objects are to be attained under observance of adequate support for the ingot generally, as well as specifically for avoiding development of cracks and fissures on the broad sides due to shrinkage.

In accordance with the preferred embodiment of the invention it is suggested to provide at least one supporting roll adjacent each of the narrow sides of the emerging ingot for support thereof and inbetween the extensions of the wide sides of the mold, directly underneath the bottom edges of narrow sides of the mold. These rolls should preferably be disposed in yielding relation and urged against the ingot at a pressure force which is between 0.2 to 1 fold the value of the square of the ingot thickness at that point (force measured in kilogram weight, thickness in cm). If the dimensions and forces are stated in inches and pounds respectively the relations are such that the force stated in pounds should be from about 0.014 to 0.07 of the value for the square of the ingot thickness stated in inches. Spray nozzles for coolant water should be disposed adjacent these rolls for spraying water at such a rate commensurate with the mold bottom dimensions. One should use a ratedensity of 200 to 800 litres water per square meter and minute.

DESCRIPTION OF THE DRAWINGS

While the specification concludes with claims particularly pointing and distinctly claiming the subject matter which is regarded as the invention, it is believed that the invention, the objects and features of the invention and further objects, features and advantages thereof will be better understood from the following description taken in connection with the accompanying drawings in which:

Figure 2:
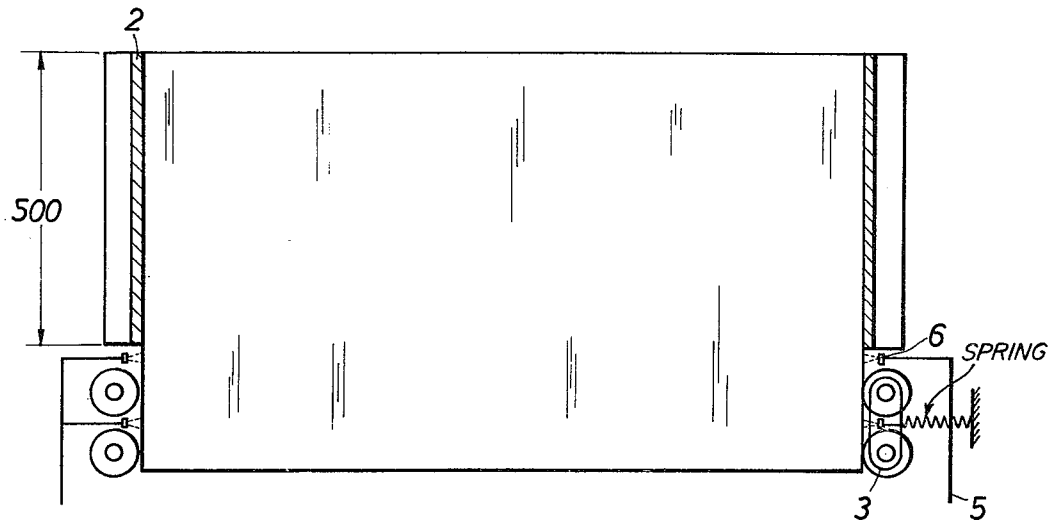
FIG. 2 is a side elevation of the same mold but seen towards one of the narrow sides.
Figure 1:
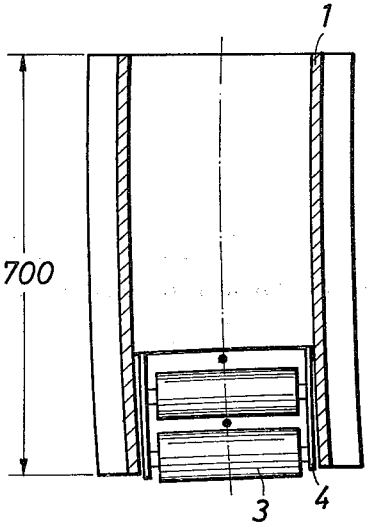
FIG. 1 is a side elevation of a mold for continuous casting as seen towards a wide side and improved in accordance with the preferred embodiment of the invention.

Proceeding now to the detailed description of the drawings, the Figures show a mold with wide mold sides 1 and narrow sides 2. It is assumed that the mold sides are liquid cooled as is conventional, and for purposes of explaining the best mode of practicing the invention it may be assumed by way of example, that a slab ingot of 300 mm thickness (about 12 inches) is to be cast.

The narrow sides 2 are shorter than the wide sides 1 so that the latter project beyond the former in the bottom portion of the mold which, of course is open at the bottom, but the bottom opening is not established in a horizontal plane. Such molds are usually from 500 to 1200 mm long. In the present example, the wide mold sides 1 are 700 mm long (about 28 inches) while the narrow and short sides 2 are 500 mm (about 20 inches) long.

The 200 mm long extensions of the wide sides 1 define two zones or gaps, where the narrow sides of the emerging ingot are already exposed, while the wide sides are still covered and supported by the mold. A pair of rolls 3 is disposed in each of these zones or gaps, one above the other as to each pair and with an axial spacing of 100 mm (about 4 inches). These rolls engage and support the emerging ingot at its narrow sides for completing the support of the ingot otherwise still provided by the wide sides 1.

A frame 4 is provided for journalling these rolls, whereby the frame 4 is actually constituted by water tanks at the narrow mold sides. The resiliently yielding and adjustable mounting of rolls is shown, for example, in U.S. Pat. Nos. 2,804,663 and 3,263,284. The rolls as so journalled are adjusted and held so as to exert a force of 300 kilogram weight onto the ingot. The ingot is assumed to be 300 mm thick (about 12 inches). Please note that 300mm = 30cm, and 900 $cm^2$ gives an equivalent of 900 kilogram weight maximum force, 180 kg minimum force as per rule above. The 300 kilogram weight pressure force as defined is well in that range.

As is schematically indicated, pipes or ducts 5 between and above the rolls lead to nozzles 6 which are spaced apart from but disposed rather close to the ingot for immediate spray cooling the ingot. Since it was assumed that the ingot is about 300 mm thick (about 12 inches), one needs about 10 liters of water per side and minute.

The invention is not limited to the embodiments described above but all changes and modifications thereof not constituting departures from the spirit and scope of the invention are intended to be included.

We claim:

1. In a mold for continuous casting of slab ingots and having wide and narrow sides accordingly, the wide sides extending lower than the narrow sides to establish two gaps below the bottom lines of the narrow sides, the improvement comprising:

at least one roll respectively in each of said gaps, directly underneath the bottom edge of the respective narrow side and being journalled for engagement with and exertion of controlled pressure upon narrow ingot sides as emerging from the mold.

2. In a mold as in claim 1, wherein the rolls are mounted resiliently and adjustable.

3. In a mold as in claim 1, there being spray nozzles disposed adjacent the rolls for spraying coolant onto the ingot surface as exposed in the gap.

* * * * *